United States Patent [19]

Honsberger

[11] Patent Number: 4,920,467

[45] Date of Patent: Apr. 24, 1990

[54] CONTROLLED STRATIFIED RANDOM AREA ILLUMINATOR

[76] Inventor: Calvin P. Honsberger, 1275 Grange Ave., Collegeville, Pa. 19426

[21] Appl. No.: 190,331

[22] Filed: May 5, 1988

[51] Int. Cl.[5] ..... G09F 3/04

[52] U.S. Cl. ..... 362/226; 362/251; 362/800; 362/811; 40/452; 439/46

[58] Field of Search ..... 362/249, 250, 251, 800, 362/226, 811; 439/43, 44, 45, 46, 52; 40/452

[56] References Cited

U.S. PATENT DOCUMENTS

| | | | |
|---|---|---|---|
| 3,258,730 | 6/1966 | Husband et al. | 439/46 |
| 4,271,408 | 6/1981 | Teshima et al. | 362/800 |
| 4,547,840 | 10/1985 | Tinder | 362/226 |
| 4,570,206 | 2/1986 | Deutsch | 362/800 |

*Primary Examiner*—Ira S. Lazarus
*Assistant Examiner*—Richard R. Cole
*Attorney, Agent, or Firm*—Joseph W. Molasky & Assocs.

[57] ABSTRACT

A controlled stratified random area illuminator is constructed of a base comprised of alternate layers of conductive and insulating material and a plurality of illuminating devices adapted to be positioned in a predetermined array on the base to provide an illuminating display. Each illuminating device comprises a light source and a post which carries a pair of leads for supplying current to the light source, one lead being adapted to make electrical contact with a common layer of conductive material and another lead which is adapted to make electrical contact with one of the other conductive layers. The illuminating devices and the base are constructed so that the illuminating devices can be installed by pushing them into the base material to penetrate the conductive and insulating layers to a predetermined depth. A selective switch controls the supply of electrical current to the conductive layers for illuminating a predetermined array of illuminating devices.

11 Claims, 2 Drawing Sheets

FIG. 1
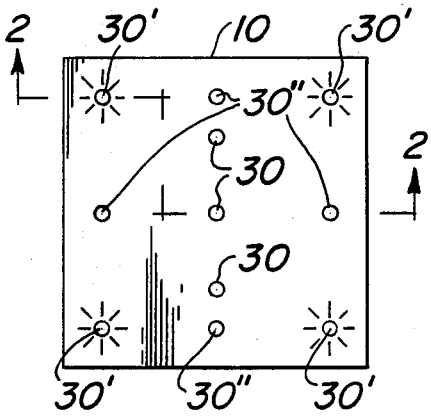
FIG. 5
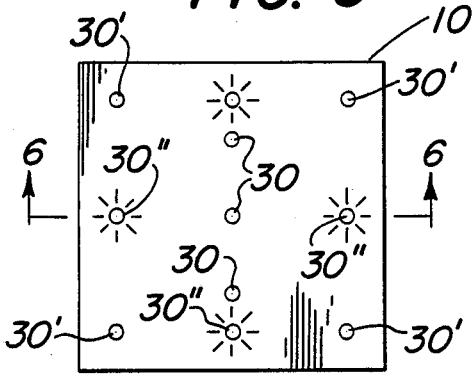
FIG. 6
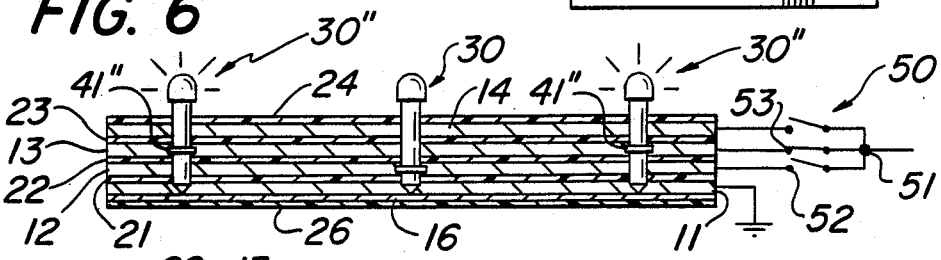
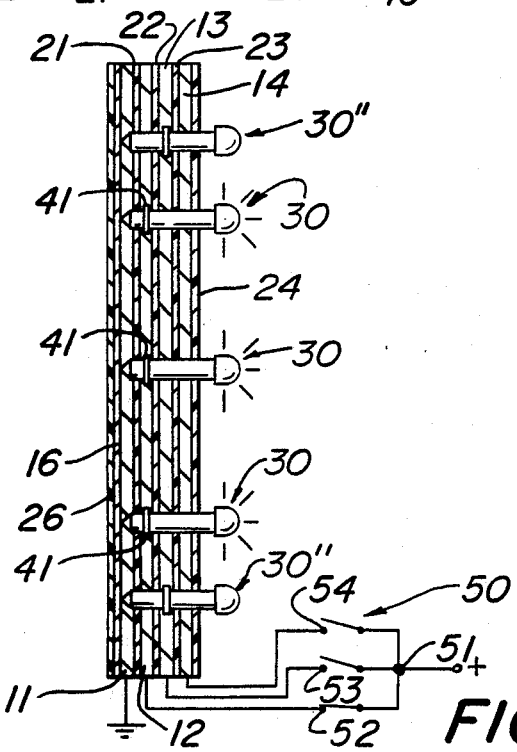
FIG. 8
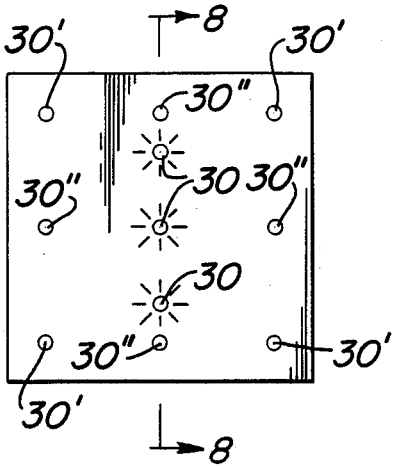
FIG. 7

CONTROLLED STRATIFIED RANDOM AREA ILLUMINATOR

BACKGROUND OF THE INVENTION

1. Field of the Invention

This invention relates generally to the field of illuminating devices, and more particularly to illuminating devices of the type used in signs and advertising displays, electrical lighting fixtures, and other types of lighting equipment.

2. Description of the Prior Art

There are many types of illuminating devices of the type to which the invention relates in general use today as this is an old art. Two patents known to the inventor are U.S. Pat. Nos. 4,340,929 and 4,593,485.

SUMMARY OF THE INVENTION

It is the general object of the invention to provide a controlled stratified random area illuminator which (1) is inexpensive, (2) is easy to manufacture and assemble, and (3) can provide a plurality of different lighting patterns in a programed sequence or randomly as desired.

Briefly stated, the general objects of the invention are achieved by a illuminator construction which comprises a base including a plurality of conductive layers and a plurality of insulating layers arranged in alternating layers, and a plurality of illuminating means adapted to be positioned in an array on said base. Each of the illuminating means includes a light source and a post carrying a pair of electrical leads for conducting current to the light source. Each post is constructed and arranged so that it can penetrate all of the conductive and insulating layers to be positioned on said base with its light source located above the outermost layer of the base so as to be visible. Each post has a first lead of a length to position an electrical contact thereon so that it makes an electrical contact with a common conductive layer, and a second lead of a length to position an electrical contact thereon so that it makes an electrical contact with one of the other conductive layers. A switch means is provided for controlling the supply of electrical current to a selected pair of conductive layers so that a predetermined array of illuminating means are supplied with current for illumination thereof.

BRIEF DESCRIPTION OF THE DRAWINGS

FIG. 1 is a plan view of a controlled stratified random area illuminator in accordance with the invention.

FIG. 5 is a plan view of the illuminator shown in FIG. 1 with the device in another illuminating condition.

FIG. 6 is a sectional view taken on line 6—6 of FIG. 5.

FIG. 7 is a plan view of the illuminator shown in FIG. 1 with the device in still another illuminating condition.

FIG. 8 is a sectional view taken on line 8—8 of FIG. 7.

DETAILED DESCRIPTION OF THE PREFERRED EMBODIMENT

Figures 2, 3, 4:
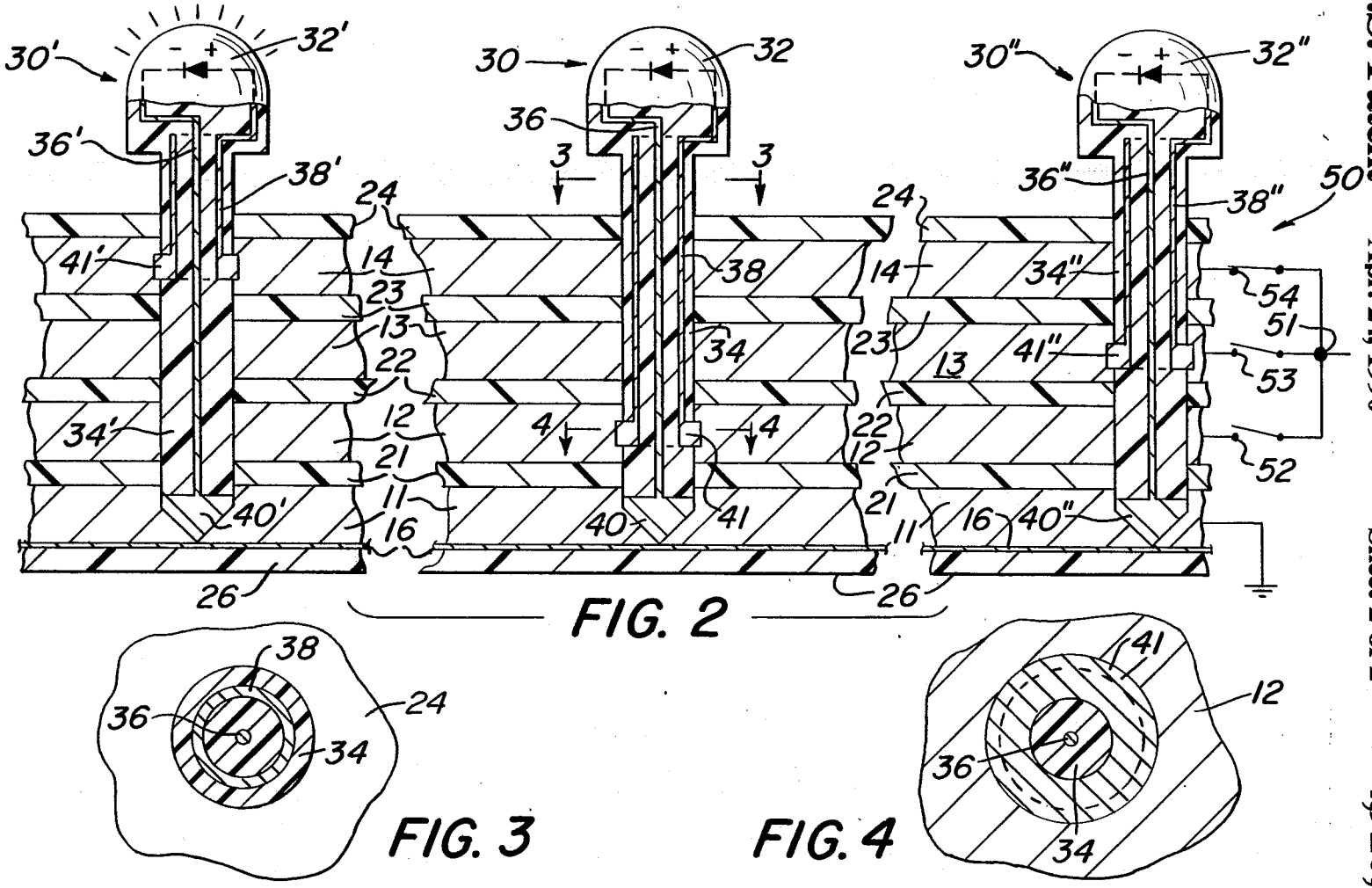
FIG. 2 is a sectional view taken on line 2—2 of FIG. 1.
FIG. 3 is a sectional view taken on line 3—3 of FIG. 2.
FIG. 4 is a sectional view taken on line 4—4 of FIG. 4.

Referring to the Drawings in detail, there is shown a controlled stratified random area illuminator in accordance with the invention. The illuminator shown in FIG. 1 comprises a rectangular base 10 which includes a plurality of conductive layers and a plurality of insulating layers arranged in a stratified arrangement of alternating layers as is apparent from a consideration of FIGS. 2, 6 and 8. In the embodiment of the invention shown and described herein there are provided four conductive layers 11, 12, 13 and 14 and four insulating layers 21, 22, 23 and 24. At the bottom of the base 10 there is provided a metallic sheet 16 and a bottom insulating cover 26. The sheet 16 is made of relatively strong material so as to form a stop for the positioning of the illuminating means as will be described more fully hereafter.

Each of the conductive layers 11–14 is made of a suitable electrically conducting material such as a conductive foam-like wafer, similar to the material used to protect integrated circuits in shipment and storage, or other suitably conductive material so as to enable the posts of the illuminating means to penetrate the material for the reasons to be described hereafter. The insulating layers 21–24 are made of a suitable electrical insulating material of a type that can be penetrated by the posts of the illuminating means as will be described hereafter. Typical of the insulating material which may be used include, for example, urethane open cell foam and similar type materials.

The illuminator of the invention also comprises a plurality of specially constructed illuminating means 30, 31' and 30'' which are adapted to be arranged on the base 10 so as to provide an illuminating array of a desired configuration. Since the illuminating means 30, 30' and 30'' are of essentially the same construction (the only difference being the length of one of the pair of electrical leads), only one illuminating means 30 will be described in detail. Each of the illuminating means 30 has a light source 32, such as a light emitting diode (LED) as shown in the Drawings. It will be apparent that the light source may also be made of a suitable type of incandescent or any other suitable electro-illuminating device. Each illuminating means 30 also includes a post 34 for containing a pair of electrical leads 36 and 38 that supply current to the light source 32. Each post 34 comprises an elongated cylindrical portion made of an insulating material, such as glass or plastic. The upper end of each post 34 is formed as an enlarged, generally rounded head of material for encasing the lighting circuit of the LED light source and to provide an illuminating lens therefor.

The one lead 36 of each of the posts 30 includes an electrically conducting wire portion that extends centrally along the longitudinal axis of the cylindrical portion of the post 34 and that terminates at one end with an electrical contact member 40 forming a pointed lower end of post 34. As its other end, lead 36 terminates at one terminal end of the LED lighting circuit. As is shown in FIG. 2, lead 36 extends throughout the entire length of post 30. The other lead 38 of each post 34 is in the form of a hollow cylinder arranged in concentric relation around lead 36. Lead 38 has an annular electrical contact 41 formed at its lower end to extend radially to the outer surface of the cylindrical portion of post 34 as is shown in FIG. 2. The upper end of lead 38 is connected to the other terminal end of the LED lighting circuit as shown in FIG. 2.

Illuminating means 30′ and 30″ are the same as illuminating means 30 wherefore corresponding parts have the same reference numerals with primes and double primes added, respectively.

In accordance with the invention, each of the leads 36, 36′ and 36″, which are of equal length, is arranged to extend so as to make electrical contact with the lowermost conductive layer 11 (also referred to as a common conductive layer) when the illuminating means 30, 30′ and 30″ are inserted in position in the base 10 as shown in FIG. 2. This electrical contact is made by the pointed conductors 40, 40′ and 40″. The other leads 38, 38′ and 38″ of the illuminating means 30, 30′ and 30″, respectively, are of three different lengths depending on which of the conductive layers 12, 13 or 14 they are to be electrically connected with. Thus, as viewed in FIG. 2, the illuminating means 30′ shown on the lefthand side has a short lead 38′ arranged to make electrical contact with the upper conductive layer 14 by means of its electrical contact 41′. Also, the illuminating means 30″ shown in the righthand side of FIG. 2 has its lead 38″ made of a length so as to make electrical contact with the conductive layer 13 by means of its annular electrical contact 41′. The illuminating means 30 shown in the middle of FIG. 2 has its lead 38 made of a length so as to make electrical contact with conductive layer 12 at its annular electrical contact 41 as is apparent from a consideration of this figure.

By this construction, the illuminator in accordance with the invention comprises three groups of illuminating means, 30, 30′ and 30″ which are adapted to make electrical contact between a common conductive layer 11 and one of the other conductive layers 12, 13 and 14 through the lighting circuit of an LED light source 32, 32′ and 32″, respectively.

As discussed above, the illuminating means 30, 30′ and 30″ are installed by pushing them so as to penetrate into the insulating and conducting layers 11–14 and 21–24 of the base 10 in a direction perpendicular to the planes thereof until each pointed contact member 40, 40′ and 40″ makes contact with the stop provided by metallic layer 16. With illuminating means 30, 30′ and 30″ in their installed positions as shown in FIG. 2, their illumination can be controlled by controlling the supply of electric current to selected ones of the conductive layers 11, 12 and 13.

The control means is shown in FIGS. 2, 6 and 8 and comprises a three-pole switch 50 that is arranged to connect an input terminal 51 to the positive side of a power supply and to position a selected one of three switch arms in electrical contact with a selected one of three output terminals 52, 53 and 54 which are connected through electrical lines to the three conductive layers 12, 13 and 14, respectively. The common conductive layer 11 is connected by an electrical line to ground. When it is desired to illuminate the illuminating means 30′ which are electrically connected to the conductive layer 14, the switch 50 is positioned as shown in FIG. 2 with the upper switch arm in a closed position and the other switch arms in their open positions. Likewise, when it is desired to illuminate the illuminating means 30″ connected to the conductive layer 13, the switch 50 is positioned as shown in FIG. 6 with the middle switch arm in the closed position and the other switch arms in their open positions. When it is desired to illuminate the illuminating means 30 connected to the conductive layer 12, the siwtch 50 is positioned as shown in FIG. 8 with the lowermost switch arm in the closed position and the other switch arms in their open positions.

It will be apparent that by the use of the illuminator in accordance with the invention and the proper selection and positioning of the illuminating means 30, 30′ or 30″, it is possible to make many different patterns of illuminating lights which can be made to light up from one to another in a programmed sequence or in a random arrangement as desired. By way of illustration, the illuminating means 30′ are shown in an array which can provide square-shaped illuminated display. To this end, four of the illuminating means 30′ are arranged in the corners of the rectangular base 10 as shown in FIG. 1. With the switch 50 in the position as shown in FIG. 2, the four illuminating means 30′ in electrical contact with conductive layer 14 will be illuminated to provide a lighted square as is shown in FIG. 1.

In a like manner, four illuminating meand 30″ are arranged to provide a diamond-shaped illuminated display as is apparent from a consideration of FIG. 5. In this condition, the switch 50 is positioned as shown in FIG. 6 to provide an illumination of the four illuminating means 30″ which are electrically connected to the conductive layer 13.

In a like manner, there are provided three illuminating means 30 arranged in a line to present an illuminated display of a straight line as shown in FIG. 7. In this condition of the parts, the switch 50 is in the position as shown in FIG. 8 so as to provide illumination of the three illuminating means 30 which are electrically connected to conductive layer 12.

In the use of the controlled stratified random area illuminator in accordance with the invention a base 10 of the proper size and proper number of layers of insulating and conducting material for the desired application is selected and connected in an electrical control circuit as described hereinbefore. Illuminating devices of the required type, size and color are then arranged in an array in accordance with the requirement for the display to be provided. For example, the top surface 24 could be marked in some way to provide a plan of the light arrangement before actual installation. Then the illuminating means 30, 30′ and 30″ etc. are inserted directly into the stratified material pushing them all the way in until they make contact with the stop 16 as shown in FIG. 2. All the lights of one display pattern are preferably installed before installing the others. Then the selector switch 50 is programmed to position its switch arms to supply current to the selected ones of the conductive layers to provide the illuminating display desired.

A typical illuminator in accordance with the invention would comprise a two-by-three foot sheet-like base of stratified material with about one hundred light emitting diodes It will be apparent that various changes may be made in the construction and arrangement of parts without departing from the scope of the invention as defined by the following claims. For example, it will be apparent that any number of layers of conducting and insulating layers may be provided. Also, the various types of light sources may be utilized and various constructions and arrangements of the posts may be made.

What is claimed is:

1. A random area illuminator comprising:

a base including a plurality of conductive layers and a plurality of insulating layers, said conductive and insulating layers being arranged in alternating layers, a plurality of illuminating means adapted to be mounted on said base in an illuminating array, each of said illuminating means having a light source and a post having said light source at one end thereof, each of said posts comprising first and second insulated electrical leads for supplying electric current to said light source mounted thereon, each of said posts being adapted to extend from the outer layer of said base to a common conductive layer of said base, said first lead of each post having an electrical contact arranged to provide electrical connection to said common conductive layer, said second lead of each post having an electrical contact arranged to provide electrical connection to another one of said conductive layers, and control means for supplying electric current to selected ones of said other conductive layers.

2. An illuminator according to claim 1 wherein each of said posts has a pointed portion at the other end thereof which is opposite said light source so that said illuminating means can be mounted on said base by causing said posts to penetrate said conductive and insulating layers.

3. An illuminator according to claim 2 including a layer of relatively impenetrable material to provide a stop to the penetration of said conductive and insulating layers by said posts.

4. An illuminator according to claim 3 wherein each of said posts comprises an elongated cylindrical portion of insulating material, said first lead comprises an electrically conductive wire extending longitudinally throughout the length of said cylindrical portion.

5. An illuminator according to claim 4 wherein each of said posts comprises an electrical contact at the end of said wire opposite said light source.

6. An illuminator according to claim 5 wherein each of said posts comprises an electrical contact extending around the outer surface of said cylindrical post portion and located at the end of said second lead opposite said light source.

7. An illuminator according to claim 6 wherein said second lead comprises a hollow tube positioned to enclose said wire forming said first lead.

8. An illuminator according to claim 1 wherein said light source comprises a light emitting diode.

9. An illuminator according to claim 1 wherein said control means comprises a multiple position switch having a switch contact associated with each of said other conductive layers and circuit means for connecting each of said switch contacts to one of said other conductive layers.

10. An illuminator according to claim 1 including at least three of said other conductive layers and at least three of said insulating layers alternately arranged with said three conductive layers.

11. An illuminator according to claim 10 including a first group of illuminating means each of which has its second lead constructed and arranged to provide electrical contact with a first one of said three conductive layers, a second group of illuminating means each of which has its second lead constructed and arranged to provide electrical contact with a second of said three conductive layers, and a third group of illuminating means each of which has its second lead constructed and arranged to provide electrical contact with a third of said three conductive layers.

* * * * *